US005290432A

United States Patent [19]

Friedman et al.

[11] Patent Number: 5,290,432

[45] Date of Patent: Mar. 1, 1994

[54] METHOD OF TREATING TOXIC AROMATIC HALOGEN-CONTAINING COMPOUNDS BY ELECTROPHILIC AROMATIC SUBSTITUTION

[75] Inventors: Arthur J. Friedman, Deerfield; Yuval Halpern, Skokie, both of Ill.

[73] Assignee: Chemical Waste Management, Inc., Oak Brook, Ill.

[21] Appl. No.: 736,474

[22] Filed: Jul. 26, 1991

Related U.S. Application Data

[63] Continuation-in-part of Ser. No. 520,732, May 9, 1990, Pat. No. 5,043,054.

[51] Int. Cl.[5] ..... C10G 17/02

[52] U.S. Cl. ..... 208/262.5; 208/262.1; 585/240; 585/241; 585/6.3; 588/206; 588/207; 210/909

[58] Field of Search ..... 208/262.1, 262.5; 585/240, 241, 6.3, 8; 588/206, 207; 210/909

[56] References Cited

U.S. PATENT DOCUMENTS

| | | | |
|---|---|---|---|
| 2,019,337 | 10/1935 | Clark | 260/142 |
| 2,370,113 | 2/1945 | Jenkins | 252/577 |
| 3,634,520 | 1/1972 | Crivello | 544/358 |
| 3,981,933 | 9/1976 | Cook et al. | 558/524 |
| 4,327,027 | 4/1982 | Howard et al. | 208/262.5 |
| 4,337,368 | 6/1982 | Pytlewski et al. | 208/262.5 |
| 4,349,380 | 2/1984 | Pytlewski et al. | 75/721 |
| 4,351,978 | 9/1982 | Hatano et al. | 208/262.5 |
| 4,353,793 | 10/1982 | Brunelle et al. | 208/262.5 |
| 4,387,018 | 6/1982 | Cook et al. | 208/262.5 |
| 4,400,552 | 8/1983 | Pytlewski et al. | 208/262.5 |
| 4,417,977 | 11/1983 | Pytlewski et al. | 585/469 |
| 4,430,208 | 2/1984 | Pytlewski et al. | 208/262.5 |
| 4,447,541 | 5/1984 | Peterson | 208/262.5 |
| 4,460,797 | 7/1984 | Pytlewski et al. | 568/770 |
| 4,468,297 | 8/1984 | Sawyer et al. | 588/207 |
| 4,471,143 | 9/1984 | Pytlewski et al. | 568/715 |
| 4,483,716 | 11/1984 | Heller | 588/207 |
| 4,602,994 | 7/1986 | Pytlewski et al. | 208/262.5 |
| 4,632,742 | 12/1986 | Tundo | 210/909 |
| 4,662,948 | 5/1987 | Weitzman | 210/909 |
| 4,663,027 | 5/1987 | Mendiratta et al. | 208/262.5 |
| 4,748,292 | 5/1988 | Mendiratta et al. | 208/262.5 |
| 4,764,256 | 8/1988 | Way | 208/262.5 |
| 4,776,947 | 10/1988 | Streck et al. | 210/909 |
| 5,039,350 | 8/1991 | Rogers et al. | 208/262 |
| 5,078,868 | 1/1992 | Robertson | 210/909 |

FOREIGN PATENT DOCUMENTS

| | | | |
|---|---|---|---|
| 1199751 | 12/1985 | U.S.S.R. | C02C 143/36 |

*Primary Examiner*—Helane E. Myers

*Attorney, Agent, or Firm*—Allegretti & Witcoff, Ltd.

[57] ABSTRACT

An improved method for detoxifying waste materials contaminated with halogenated aromatic hydrocarbons is disclosed. The method provides for detoxification of halogenated aromatic compounds by electrophilic aromatic substitution. The method also provides for the dehalogenation of the lower congeners of such halogenated aromatic compounds, as a result of chemical activation via electrophilic aromatic substitution, followed by nucleophilic aromatic dehalogenation. In addition, the method provides for the more complete dehalogenation of mixtures of halogenated aromatic compounds that contain both higher and lower congeners by increasing the efficiency of dehalogenation of the lower congeners.

9 Claims, No Drawings

METHOD OF TREATING TOXIC AROMATIC HALOGEN-CONTAINING COMPOUNDS BY ELECTROPHILIC AROMATIC SUBSTITUTION

BACKGROUND OF THE INVENTION

This is a continuation-in-part of U.S. patent application Ser. No. 7/520,732, filed May 9, 1990 now U.S. Pat. No. 5,043,054.

FIELD OF THE INVENTION

The present invention relates to processes for detoxifying waste or contaminated materials containing halogenated organic compounds, such as transformer oils, dielectric fluids, wood preservatives, halogenated by-products and residues from the manufacture of halogenated pesticides and soils contaminated with discharges of these materials.

INFORMATION DISCLOSURE STATEMENT

Polychlorinated biphenyls (PCBs) have shown great utility for use in dielectric fluids, due to their outstanding thermal stability, resistance to oxidation and chemical agents, as well as excellent electrical insulating qualities. However, the discovery of PCBs in environmental samples and subsequent recognition of their potential toxic hazards resulted in restricted sales of PCBs to applications in closed electrical systems, and ultimately to the termination of PCB production in 1977.

PCBs represent only one of a large number of halogenated organic compounds that are currently stored for want of an economical and effective means of disposal. Storage of such chemicals, however, is only a stopgap measure. Storage capacity is not unlimited and the quantity of hazardous chemicals generated by industry continuously increases. Thus, effective and affordable methods for destroying halogenated organic compounds are needed.

The difficulty in decomposing halogenated organic compounds arises from the great stability of the carbon-halogen covalent bond. The energy of a carbon-chlorine bond, for example, is on the order of 84 kcal/mole. Thus, many halogenated organic compounds resist biodegradation as well as most chemical decomposition methods. Most known chemical methods achieve only partial dehalogenation, and involve the use of expensive reagents, inert atmospheres, elevated temperatures, complex apparatus, substantial energy consumption or other undesirable parameters. Physical means of disposal have similar problems. Incineration requires substantial energy consumption and complex equipment and may form residual ash, which may require additional treatment.

Thus, there is a need for effective and economical processes for the decomposition of halogenated organic compounds. Chemical processes have shown some promise for such applications. An ideal chemical process would allow very substantial dehalogenation of halogenated hydrocarbons at low cost, using limited reagent, time and energy resources.

The problems associated with disposal of halogenated organic compounds are well known in the art. Chemical processes for dehalogenation of various hydrocarbons have been described.

Howard et al., U.S. Pat. No. 4,327,027, describe a method for chemical detoxification of toxic chlorinated aromatic compounds comprising incubation of such compounds at elevated temperatures with an amount, in excess of stoichiometric, of alkali metal alcoholates of alkanols, alkoxyalkane glycols, alkanepolyols and monoalkyl ethers thereof.

Pytlewski et al., U.S. Pat. No. 4,349,380 disclose methods for recovering metals from chemically combined forms through the use of alkali metals with polyglycols with at least 4 carbon atoms or polyglycol monoalkyl ethers with at least 5 carbon atoms, and oxygen.

Pytlewski et al., U.S. Pat. No. 4,337,368 relates to the use of alkali metals with polyglycols with at least 4 carbon atoms or polyglycol monoalkyl ethers with at least 5 carbon atoms and oxygen to decompose halogenated organic compounds.

Hatano et al., U.S. Pat. No. 4,351,978 relates to a method for dechlorination of PCB via hydrogenation, and employing an alkaline aqueous/alcohol solution, molecular hydrogen and a hydrogenation catalyst.

Brunelle et al., U.S. Pat. No. 4,353,793 disclose a method for removing PCBs from contaminated nonpolar organic solvents using monocapped polyalkyleneglycol alkyl ethers with alkali metal hydroxides.

Cook et al., U.S. Pat. No. 4,387,018 describe a method extracting PCBs from oil using methanol.

Pytlewski et al., U.S. Pat. No. 4,400,552 disclose a method for decomposing halogenated organic compounds using a reagent comprising the product of the reaction of an alkali metal hydroxide with a polyglycol with at least 4 carbon atoms or a polyglycol monoalkyl ether with at least 5 carbon atoms.

Pytlewski et al., U.S. Pat. No. 4,417,977 relates to methods for removing halogenated organic compounds from organic functional fluids through the use of alkali metals with polyglycols with at least 4 carbon atoms or polyglycol monoalkyl ethers with at least 5 carbon atoms and oxygen.

Pytlewski et al., U.S. Pat. No. 4,430,208 describe a three step process for the removal and detoxification of PCBs from contaminated dielectric fluids. The process comprises extraction with polyethylene glycol followed by extraction with cyclohexane, followed by incubation with a reagent derived from the reaction of sodium or sodium hydroxide, polyethylene glycol and oxygen.

Peterson, U.S. Pat. No. 4,447,541 discloses a method for reducing the halogen content of highly-halogenated organic soil contaminants through the use of an alkali reagent, such as an alkali metal hydroxide, an alkali metal hydroxide/alcohol or glycol mixture, or an alkoxide, in conjunction with a sulfoxide catalyst.

Tundo, U.S. Pat. No. 4,632,742 discusses a method for decomposing halogenated organic compounds through an anaerobic process using Nixolens (R), alcohols, polyethylene glycols or polyglycol monoalkyl ethers with at least 5 carbon atoms, together with an oxidizing agent.

Weitzman, U.S. Pat. No. 4,662,948 relates to a method for removing PCBs and dioxins from soils through extraction of soils with a mixture of halogenated hydrocarbons and a polar solvent.

Pytlewski et al., U.S. Pat. No. 4,460,797 disclose a method for the decomposition of halogenated organic compounds using a reagent comprising the product of the reaction of an alkali metal hydroxide with a polyglycol with at least 4 carbon atoms or a polyglycol monoalkyl ether with at least 5 carbon atoms.

Pytlewski et al., U.S. Pat. No. 4,471,143 relates to a composition of matter in liquid form comprising a coordination complex which is the product of the reaction of an alkali metal or alkali metal hydroxide with a polyglycol with at least 4 carbon atoms or a polyglycol monoalkyl ether with at least 5 carbon atoms.

Heller, U.S. Pat. No. 4,483,716 discusses processes for removing chemical substances, including halogenated organic compounds, from porous substrates, using a poultice comprising particulate matter and a volatile solvent, then destroying such halogenated hydrocarbons using the product of the reaction of an alkali metal or alkali metal hydroxide with a polyglycol with at least 4 carbon atoms or a polyglycol monoalkyl ether with at least 5 carbon atoms.

Pytlewski et al., U.S. Pat. No. 4,602,994 disclose a method for the removal of halogenated organic compounds from organic functional fluids using, in an inert atmosphere, the product of the reaction of an alkali metal or alkali metal hydroxide with a polyglycol with at least 4 carbon atoms or a polyglycol monoalkyl ether with at least 5 carbon atoms.

Mendiratta et al., U.S. Pat. No. 4,663,027 relates to a method for removing polyhalogenated hydrocarbons from nonpolar organic solutions by admixing flakes or pellets of an alkali metal hydroxide with such a solution to form a slurry of alkali metal hydroxides of uniform size, followed by reacting such slurry with a polyalkylene glycol or a monocapped polyalkylene glycol alkyl ether.

Mendiratta et al., U.S. Pat. No. 4,748,292 disclose a method for removing polyhalogenated hydrocarbons from nonpolar organic solutions, which uses, in an amount at or exceeding stoichiometric to the total number of halogen groups, a reagent comprised of an alkali metal hydroxide and a polyalkylene glycol or a monocapped polyalkylene glycol alkyl ether.

Way, U.S. Pat. No. 4,764,256 describes a method for the removal of PCBs from contaminated oil, through the use of continuous solvent extraction.

Streck et al., U.S. Pat. No. 4,776,947 disclose a method for dehalogenation of halogenated organic compounds in hydrocarbon oils through the use of alkali or alkaline earth alcoholates having at least 6 carbon atoms.

Airs et al., British Patent Specification 618,189 discloses dehydrohalogenation of dihalogen alkenes and monohalogen alkenes to produce alkynes through the use of glycol monoalkylether alcoholates.

The dehalogenation of congeners of PCBs and other halogenated aromatic compounds which contain a low number of halogen atoms per molecule (less than or equal to 4 halogen atoms/molecule) poses a particular problem. These lower congeners are less reactive towards dehalogenating agents than are congeners of higher halogen content; this property affects both direct dehalogenation of the lower congeners themselves and materials contaminated with them, as well as complete dehalogenation of higher congeners which have lower congeners as reaction intermediates. The methods described in the art for dehalogenation of the lower congeners of PCBs and other halogenated aromatic compounds involve extreme conditions and relatively long reaction times.

The present invention relates to the use of electrophilic aromatic substitution, in particular sulfonation, for the detoxification of PCBs and other halogenated aromatic compounds.

Electrophilic aromatic substitution of halogenated aromatic compounds has been described previously. The teachings of the prior art relate to the use of electrophilic aromatic substitution for the production of substituted halogenated aromatic compounds with novel and useful properties.

Clark, U.S. Pat. No. 2,019,337 teaches introducing a nitro group to PCBs by treatment with nitric acid, for the purpose of creating compounds with higher dielectric constants than PCBs.

Jenkins, U.S. Pat. No. 2,370,113 teaches chlorination of o-nitrodiphenyl to produce superior dielectric compounds.

Crivello, U.S. Pat. No. 3,634,520 teaches a process for nitrating aromatic ring compositions, including halogenated aromatic hydrocarbons, using a perfluorosaturated aliphatic acid anhydride of 4 to 8 carbon atoms and a metal nitrate or ammonium nitrate.

Cook et al., U.S. Pat. No. 3,481,933 teach a process for making nitrated aromatic compounds by treating aromatic compounds. including halogenated aromatic hydrocarbons, with concentrated (80–100%) sulfuric acid and concentrated (90–100%) nitric acid, in the presence of methylene chloride.

Yanota et al., U.S.S.R. Author's Certificate No. 1,199,751 suggests both sulfonation of halogenated hydrocarbons and subsequent dehalogenation. The teachings of this reference are not directed toward dehalogenation, however, but rather toward methods for producing sulfonated aromatic compounds.

The teachings of Yanota et al. can be distinguished from the methods of the present invention. Yanota et al. use direct sulfodechlorination for dehalogenation; the present invention uses electrophilic aromatic substitution of one of the remaining hydrogen atoms on the aromatic ring and does not directly dehalogenate the halogenated aromatic compound in this reaction. The Yanota et al. reference thus describes the use of sulfonation of halogenated aromatic compounds as a synthetic route for the production of novel substituted halogenated aromatic compounds and does not relate to detoxification of such compounds.

The present invention also relates to the use of electrophilic aromatic substitution of PCBs and other halogenated aromatic compounds, particularly lower congeners of such compounds, to activate these compounds for dehalogenation by nucleophilic aromatic substitution using metal alkoxides. The prior art broadly recites nucleophilic substitution of halogenated organic compounds using metal alcoholate nucleophiles, but no reference known to the present inventors suggests the use of electrophilic aromatic substitution to facilitate dehalogenation by subsequent nucleophilic aromatic substitution. While the related art teaches electrophilic aromatic substitution of aromatic hydrocarbons, including halogenated aromatic hydrocarbons, it neither teaches nor suggests the use of such substitution reactions as a step in the dehalogenation of these compounds by substitution with organic nucleophiles. No reference known to the present inventors discloses or suggests the methods of the present invention.

BRIEF SUMMARY OF THE INVENTION

This invention is directed toward an improved method for detoxifying waste materials containing halogenated hydrocarbons. More specifically the invention provides an improved chemical process for dehalogenating lower congeners of halogenated organic compounds. In particular the invention provides methods for detoxifying and dehalogenating lower congeners of halogenated aromatic compounds.

An object of this invention is to provide an efficient and effective chemical process for detoxifying halogenated aromatic compounds. A particular embodiment of this invention is the detoxification of halogenated aromatic compounds by electrophilic aromatic substitution. In a preferred embodiment, the present invention provides for the sulfonation of halogenated aromatic compounds.

Sulfonation of halogenated aromatic hydrocarbons is itself an object of the present invention.

Another object of the invention is to provide an efficient and effective chemical process for dehalogenating halogenated aromatic compounds that will remove one or more halogens from a variety of halogenated organic compounds. In particular, it is an object of this invention to provide a chemical process to increase dehalogenation of lower congeners of halogenated aromatic compounds. In a specific embodiment of the invention, electrophilic aromatic substitution of halogenated aromatic compounds is used as a first step in the dehalogenation process. Nucleophilic aromatic substitution is then used to dehalogenate both substituted and any residual unsubstituted halogenated aromatic compounds present in the reaction mixtures provided by the invention. The advantage of dehalogenating halogenated aromatic compounds by the two-step process provided by the present invention is that electrophilically-substituted halogenated aromatic compounds, in particular lower congeners of such compounds, are chemically activated for nucleophilic aromatic substitution. Nucleophilic aromatic substitution used to dehalogenate substituted halogenated aromatic compounds is more efficient than dehalogenation of lower congeners of unsubstituted halogenated aromatic compounds.

Another object of the invention is to provide a process that is more cost effective than existing chemical processes for the dehalogenation of halogenated organic compounds. Thus, an object of the invention is to allow for the use of reduced amounts of reagents for dehalogenation of halogenated aromatic compounds. Additionally, an object of the invention is to provide methods and reagents that would allow the process to proceed at lower temperatures, without requiring the reaction to proceed for longer periods of time. The combined effect of reduced use of reagents and elimination or reduction of the need to heat the reaction mixture provides a substantial savings in cost without sacrificing effectiveness.

An embodiment of the invention provides for the detoxification of halogenated aromatic compounds such as those found in a waste material by treating the waste material by electrophilic aromatic substitution, comprised of the step of incubating a reaction mixture at a temperature and for a period of time sufficient to form an electrophilically substituted halogenated aromatic compound, the reaction mixture comprising the waste material and an electrophilic aromatic substitution reagent selected from the group consisting of mixtures of $POCl_3$ and trifluoromethanesulfonic acid; mixtures of $HNO_3$ and $H_2SO_4$; mixtures of dimethylformamide and $POCl_3$; $H_2SO_4$; mixtures of $ClSO_3H$; mixtures of $H_2SO_4$ and $ClSO_3H$; mixtures of $SO_3$; mixtures of $H_2SO_4$ and $SO_3$; mixtures of RX and a member selected from the group consisting of $AlCl_3$, $FeCl_3$ and $BF_3$, wherein R is a straight or branched chain alkyl group between $C_1$ and $C_{20}$ and X is a halogen; and mixtures of $R_1COCl$ and a member selected from the group consisting of $AlCl_3$, $FeCl_3$ and $BF_3$, wherein $R_1$ is a straight or branched chain alkyl group between $C_1$ and $C_{20}$ or an aryl group, the reagent being present in an amount sufficient to electrophilically substitute the halogenated compound.

In a preferred embodiment, the electrophilic aromatic substitution reagent is selected from the group consisting of sulfuric acid, chlorosulfonic acid, $SO_3$, chlorosulfonic acid and sulfuric acid, and sulfuric acid and $SO_3$.

Another embodiment of the invention provides for the dehalogenation of a halogenated aromatic compound, comprised of the following steps:

(a) incubating a reaction mixture at a temperature and for a period of time sufficient to form an electrophilically substituted halogenated aromatic compound, the reaction mixture comprising the halogenated aromatic compound and an electrophilic aromatic substitution reagent selected from the group consisting of mixtures of $POCl_3$ and trifluoromethanesulfonic acid; mixtures of $HNO_3$ and $H_2SO_4$; mixtures of dimethylformamide and $POCl_3$; $H_2SO_4$; mixtures of $ClSO_3H$; mixtures of $H_2SO_4$ and $ClSO_3H$; mixtures of $SO_3$; mixtures of $H_2SO_4$ and $SO_3$; mixtures of RX and a member selected from the group consisting of $AlCl_3$, $FeCl_3$ and $BF_3$, wherein R is a straight or branched chain alkyl group between $C_1$ and $C_{20}$ and X is a halogen; mixtures of $R_1COCl$ and a member selected from the group consisting of $AlCl_3$, $FeCl_3$ and $BF_3$, wherein $R_1$ is a straight or branched chain alkyl group between $C_1$ and $C_{20}$ or an aryl group; and mixtures of $X_2$ and $FeCl_3$, wherein X is any halogen, the reagent being present in an amount sufficient to electrophilically substitute the halogenated compound; and (b) incubating a second reaction mixture at a temperature and for a period of time sufficient to at least partially dehalogenate the halogenated aromatic compound, the second reaction mixture comprising the electrophilically substituted halogenated aromatic compound and an alkoxide of a metal selected from the group consisting of lithium, sodium, potassium, rubidium, cesium, magnesium, calcium, strontium, barium and aluminum.

It is also an embodiment of the invention to provide for detoxification of a halogenated aromatic compound, comprised of the following steps:

(a) incubating a reaction mixture at a temperature and for a period of time sufficient to form an electrophilically substituted halogenated aromatic compound, the reaction mixture comprising the halogenated aromatic compound and an electrophilic aromatic substitution reagent selected from the group consisting of mixtures of $POCl_3$ and trifluoromethanesulfonic acid; mixtures of $HNO_3$ and $H_2SO_4$; mixtures of dimethylformamide and $POCl_3$; $H_2SO_4$; mixtures of $ClSO_3H$; mixtures of $H_2SO_4$ and $ClSO_3H$; mixtures of $SO_3$; mixtures of $H_2SO_4$ and $SO_3$; mixtures of RX and a member selected from the group consisting of $AlCl_3$, $FeCl_3$ and $BF_3$, wherein R is a straight or branched chain alkyl group between $C_1$ and $C_{20}$ and X is a halogen; mixtures of $R_1COCl$ and a member selected from the group consisting of $AlCl_3$, $FeCl_3$ and $BF_3$, wherein $R_1$ is a straight or branched chain alkyl group between $C_1$ and $C_{20}$ or an aryl group; and mixtures of $X_2$ and $FeCl_3$, wherein X is any halogen, the reagent being present in an amount sufficient to electrophilically substitute the halogenated compound; and (b) performing a phase separation;

(c) incubating a second reaction mixture at a temperature and for a period of time sufficient to at least partially dehalogenate the halogenated aromatic compound, the second reaction mixture comprising the oil phase of the phase separation, an alkoxide of a metal selected from the group consisting of lithium, sodium, potassium, rubidium, cesium, magnesium, calcium, strontium, barium and aluminum.

An additional embodiment of the invention provides for the detoxification of a halogenated aromatic compound, comprised of the steps:

(a) incubating a reaction mixture at a temperature and for a period of time sufficient to form an electrophilically substituted halogenated aromatic compound, the reaction mixture comprising the halogenated aromatic compound and an electrophilic aromatic substitution reagent selected from the group consisting of mixtures of $POCl_3$ and trifluoromethanesulfonic acid; mixtures of $HNO_3$ and $H_2SO_4$; mixtures of dimethylformamide and $POCl_3$; $H_2SO_4$; mixtures of $ClSO_3H$; mixtures of $H_2SO_4$ and $ClSO_3H$; mixtures of $SO_3$; mixtures of $H_2SO_4$ and $SO_3$; mixtures of RX and a member selected from the group consisting of $AlCl_3$, $FeCl_3$ and $BF_3$, wherein R is a straight or branched chain alkyl group between $C_1$ and $C_{20}$ and X is a halogen; mixtures of $R_1COCl$ and a member selected from the group consisting of $AlCl_3$, $FeCl_3$ and $BF_3$, wherein $R_1$ is a straight or branched chain alkyl group between $C_1$ and $C_{20}$ or an aryl group; and mixtures of $X_2$ and $FeCl_3$, wherein X is any halogen, the reagent being present in an amount sufficient to electrophilically substitute the halogenated compound;

(b) performing a phase separation;

(c) incubating a second reaction mixture at a temperature and for a period of time sufficient to at least partially dehalogenate the halogenated aromatic compound, the second reaction mixture comprising the oil phase of the phase separation and an alkoxide of a metal selected from the group consisting of lithium, sodium, potassium, rubidium, cesium, magnesium, calcium, strontium, barium and aluminum; and (d) washing the reaction mixture with water.

In each of these embodiments, the electrophilic aromatic substitution reagent is selected from the group consisting of sulfuric acid, chlorosulfonic acid, $SO_3$, mixtures of chlorosulfonic acid and sulfuric acid, and mixtures of sulfuric acid and $SO_3$. The preferred reagent is oleum, a mixture of sulfuric acid and $SO_3$. The preferred alkoxide is selected from the group consisting essentially of the potassium alkoxide derivatives of 2-methoxyethanol, polyethylene glycol and a monocapped polyalkylene glycol alkyl ether. The most preferred alkoxide is potassium ethylene glycol monomethyl ether (KGME).

It is a particular advantage of the present invention that detoxification of halogenated aromatic compounds can be performed in nonpolar solvents such as mineral oil. The particular halogenated aromatic compounds intended to be detoxified using the methods of the present invention, such as PCBs, PCDDs, PCDFs and halobenzenes, are preferentially soluble in mineral oil and are frequently encountered dissolved in mineral oil or an equivalently nonpolar solvent. Methods known in the prior art for detoxification of such compounds require that waste material containing these compounds be diluted in a large excess of polar solvents such as polyethylene glycol or 2-methoxyethylether (diglyme) before detoxification. Such dissolution increases the mass and volume of contaminated waste material for treatment and disposal. An advantage of the use of the methods of the present invention for the detoxification of waste material contaminated with halogenated aromatic compounds is that the amount and volume of the contaminated material to be detoxified is minimized. Another advantage is that detoxification of halogenated aromatic compounds using the teachings of the present invention avoids the additional cost of the solvent used for dissolution of the contaminated waste material prior to detoxification using methods known in the prior art.

The invention also provides a method for forming a substituted halogenated aromatic compound, comprising the step of incubating a reaction mixture at a temperature and for a period of time sufficient to form an electrophilically substituted halogenated aromatic compound, the reaction mixture comprising the halogenated aromatic compound and an electrophilic aromatic substitution reagent selected from the group consisting of mixtures of $POCl_3$ and trifluoromethanesulfonic acid; mixtures of dimethylformamide and $POCl_3$; mixtures of RX and a member selected from the group consisting of $AlCl_3$, $FeCl_3$ and $BF_3$, wherein R is a straight or branched chain alkyl group between $C_1$ and $C_{20}$ and X is a halogen; mixtures of $R_1COCl$ and a member selected from the group consisting of $AlCl_3$, $FeCl_3$ and $BF_3$, wherein $R_1$ is a straight or branched chain alkyl group between $C_1$ and $C_{20}$ or an aryl group; and mixtures of $X_2$ and $FeCl_3$, wherein X is any halogen, the reagent being present in an amount sufficient to electrophilically substitute the halogenated compound.

Specific preferred embodiments of the present invention will become evident from the following more detailed description of certain preferred embodiments and the claims.

DETAILED DESCRIPTION OF THE PREFERRED EMBODIMENTS

The present invention provides for the economical detoxification and dehalogenation of halogenated aromatic hydrocarbons. Economy can be achieved through the use of methods that utilize lower temperatures and/or smaller quantities of reagents than existing procedures. This is made possible by the fact that the method of the present invention minimizes the amount and volume of the contaminated material to be detoxified.

The present invention further provides for the efficient dehalogenation of lower congeners of halogenated aromatic compounds. The increased efficiency provided by the present invention can be applied to the direct dehalogenation of lower congeners of halogenated aromatic compounds. The method provides for the dehalogenation of the lower congeners of such halogenated aromatic compounds, as a result of chemical activation via electrophilic aromatic substitution, followed by nucleophilic aromatic dehalogenation. In addition, the method provides for more complete dehalogenation of higher congeners of halogenated aromatic compounds which are dehalogenated via lower congener reaction intermediates, by increasing the efficiency of dehalogenation of the lower congeners.

The present invention also provides for the efficient detoxification of halogenated aromatic compounds by electrophilic aromatic substitution. The changes in the chemical properties of the substituted products of the reactions provided by the methods of the present invention are sufficient to detoxify halogenated aromatic compounds.

The method of the invention is effective for detoxifying soils, other solids, or liquids that are contaminated with halogenated hydrocarbons by dehalogenating such halogenated hydrocarbons. A variety of halogenated hydrocarbons may be dehalogenated by the method of the invention, including, but not limited to PCBs, polybrominated biphenyls (PBBs), polychlorinated dibenzodioxins (PCDDs), polychlorinated dibenzofurans (PCDFs), halobenzenes, dichlorodiphenyltrichloroethane (DDT), other halogenated pesticides, and the like, or mixtures thereof. The contaminating halogenated hydrocarbons may be present in soils, other solids, or liquids at concentrations from about 1 part per billion to about 100%. When contaminated liquids are used, the method of the invention may be practiced upon such liquids directly. When contaminated soils or other solids are to be treated, such soils or other solids will be first mixed in a liquid and then treated by the method of the invention. The liquid used to prepare this mixture include but are not limited to aliphatic hydrocarbons, pyridine, dioxane, 2-methoxyethylether and other ethers, dimethylformamide, and trimethylamine.

The contaminated substances are detoxified through electrophilic aromatic substitution of the halogenated aromatic compounds. This is achieved through reaction in the presence of one of a number of mixtures of electrophilic aromatic substitution reagents, including mixtures of $POCl_3$ and trifluoromethanesulfonic acid; mixtures of $HNO_3$ and $H_2SO_4$; mixtures of dimethylformamide and $POCl_3$; $H_2SO_4$; mixtures of $H_2SO_4$ and $ClSO_3H$; mixtures of $H_2SO_4$ and $SO_3$; mixtures of RX and a member selected from the group consisting of $AlCl_3$, $FeCl_3$ and $BF_3$, wherein R is a straight or branched chain alkyl group between $C_1$ and $C_{20}$ and X is a halogen; and mixtures of $R_1COCl$ and a member selected from the group consisting of $AlCl_3$, $FeCl_3$ and $BF_3$, wherein $R_1$ is a straight or branched chain alkyl group between $C_1$ and $C_{20}$ or an aryl group, the reagent being present in an amount sufficient to electrophilically substitute the halogenated compound.

The concentration of the electrophilic aromatic substitution reagent employed will vary with the concentration of the contaminating halogenated hydrocarbons present in the soil or liquid to be treated. The ratio between the reagent and halogenated hydrocarbon may also vary. The method of the invention is carried out at temperatures, and for times sufficient to form electrophilically substituted halogenated aromatic compounds from the halogenated hydrocarbons present in the contaminated liquid or soil. The time for which the method is utilized varies inversely with the temperature employed.

In a preferred embodiment of the invention, the electrophilic aromatic substitution reagent used is selected from the group consisting of sulfuric acid, chlorosulfonic acid, $SO_3$, mixtures of chlorosulfonic acid and sulfuric acid, and mixtures of sulfuric acid and $SO_3$. Preferred reagents are comprised of mixtures of $SO_3$, including but not limited to $SO_3$ and dimethylformamide, $SO_3$ and dioxane, $SO_3$ and pyridine, $SO_3$ and trimethylamine, and $SO_3$ and $H_2SO_4$. The most preferred reagent is oleum, a mixture of 20% $SO_3$ in concentrated sulfuric acid. The amount of the electrophilic aromatic substitution reagent used is preferably between 1 and 100 equivalents, most preferably between 5 and 10 equivalents, for each equivalent of the contaminating halogenated hydrocarbons present in the soil or liquid to be treated. The reaction provided by the mixture of the halogenated aromatic hydrocarbon-containing material and the electrophilic aromatic substitution reagent is incubated at temperatures between 50° C. and 150° C., preferably between 90° C. and 130° C., most preferably 110° C. The reaction is allowed to proceed for a time that is dependent on the temperature of the reaction. For reactions incubated at the most preferred temperature, the reaction is allowed to proceed for 1 to 9 hours, more preferably 3 to 6 hours, most preferably 5 hours.

The contaminated substances are dehalogenated through electrophilic aromatic substitution of the halogenated aromatic compounds, followed by nucleophilic aromatic substitution of the substituted halogenated aromatic compounds by reaction with a metal alcoholate reagent derived from the reaction an alcohol and an alkali or alkaline earth metal or aluminum. Such a reagent can be represented by the structural formula $$M-[O-(CH_2)_yZ]_n$$

where $Z=-OCH_3$ and $y=2$, and where M= an alkali metal selected from the group consisting of lithium, sodium potassium, rubidium and cesium and $n=1$, or where M= an alkaline earth metal selected from the group consisting of magnesium, calcium, strontium and barium and $n=2$, or where M= aluminum and $n=3$.

The reaction between the above reagent and the halogenated aromatic compound (R—X), results in the derivative $R-O-(CH_2)_y-Z$ and M—X, where R represents the hydrocarbon and X represents the halogen.

The concentration of the alkali or alkaline earth metal or aluminum alcoholate of the alcohol to be used will vary with the concentration of the contaminating halogenated hydrocarbons present in the electrophilic aromatic substitution reaction mixture to be treated. The ratio between the reagent and halogenated hydrocarbon may also vary. The method of the invention is carried out at temperatures, and for times sufficient to substantially dehalogenate the halogenated hydrocarbons present in the reaction mixture. The time for which the method is utilized to dehalogenate halogenated hydrocarbons varies inversely with the temperature employed. At preferred temperatures, dehalogenation occurs within about five hours.

In a preferred embodiment of the invention, the formation of the alkali or alkaline earth metal or aluminum alcoholate of 2-methoxyethanol or other alcohol may take place as the reaction with the halogenated hydrocarbons proceeds, i.e., the hydroxide of an alkali or alkaline earth metal or aluminum, the 2-methoxyethanol or other alcohol, and the reaction mixture containing the halogenated hydrocarbon may be added together at approximately the same time. In another preferred embodiment of the invention, the alkali or alkaline metal or aluminum alcoholate may be formed prior to the reaction with the halogenated hydrocarbon by mixing together the hydroxide of an alkali or alkaline earth metal or aluminum with the 2-methoxyethanol and incubating together at a temperature from about 20° C. to about 135° C. and for a time from about 15 minutes to about 9 hours, thus allowing formation of the metal alcoholate prior to the addition of the halogenated hydrocarbon.

The alkali metals used in the method of the invention include lithium, sodium, potassium, rubidium, and cesium. The alkaline earth metals used in the method of the invention include magnesium, calcium, strontium and barium. Alkali metals, alkaline earth metals and aluminum are each used in the metal hydroxide form for the purposes of the present invention.

The ability to use smaller quantities of reagents than is required for other dehalogenation processes and the ability to practice the method of the invention at temperatures lower than those described for other dehalogenation processes without substantial loss of effectiveness, provides for an economical and useful alternative to previously accepted practices relating to the destruction of halogenated hydrocarbons. These unexpected features are made possible by the surprising discoveries that the metal alcoholate of 2-methoxyethanol is a more efficient reagent for the dehalogenation of halogenated hydrocarbons than any other glycol monoalkyl ether.

The increased efficiency of dehalogenation of halogenated aromatic compounds provided by the present invention results from the fact that the lower congeners of halogenated aromatic compounds are activated for the nucleophilic aromatic dehalogenation reaction as a consequence of the electrophilic aromatic substitution of the aromatic ring. For purposes of the invention, "activated halogenated aromatic compounds" refers to halogenated aromatic compounds that contain additional electron withdrawing constituents on the aromatic ring(s) other than the halogen groups. Unactivated halogenated aromatic compounds would include lower congeners of PCBs, lower congeners of PCDDs, lower congeners of PCDFs, and mono- and dichlorobenzenes, wherein the lower congeners of the PCBs, PCDDs, PCDFs, and both mono- and dichlorobenzene do not contain any non-halogen electron withdrawing groups on the aromatic rings. In a preferred embodiment, the electrophilic substitution reagents used are selected from the group consisting of sulfuric acid, chlorosulfonic acid, mixtures of chlorosulfonic acid and sulfuric acid, $SO_3$, and mixtures of sulfuric acid and $SO_3$. The most preferred reagent is oleum.

Those skilled in the art will recognize that waste materials contaminated with halogenated aromatic compounds may contain a mixture of halogenated aromatic compounds, wherein the mixture may include the unactivated halogenated aromatic compounds envisioned by the invention, as well as activated halogenated aromatic compounds, i.e., halogenated aromatic compounds having electron withdrawing constituents other than halogen groups on the aromatic ring. Such electron withdrawing constituents other than halogens include but are not limited to nitro groups ($-NO_2$), cyanide ($-CN$), aldehyde and organic acid ($-CHO$ and $-COOH$, respectively), and quaternary amine ($-N(CH_3))_3^+$ groups. In the case of such mixtures, methods of the invention provide an effective means of dehalogenating all halogenated aromatic compounds in the mixture, including the unactivated halogenated aromatic compounds. Thus, the invention specifically includes the treatment of waste materials contaminated with mixtures of halogenated aromatic compounds, so long as the mixture contains at least some unactivated halogenated aromatic compounds envisioned by the invention.

The following examples are provided as means for illustration and are not limiting in nature:

EXAMPLE 1

Chlorosulfonation of Chlorobenzene in Mineral Oil

To a 250 mL three neck round bottom flask, equipped with magnetic stirrer, pressure equalizing addition funnel, thermometer and reflux condenser, were added a solution of 2.25 g (0.02 mole) chlorobenzene in 40.00 mL mineral oil. To this 11.65 g (0.10 mole) chlorosulfonic acid was added slowly, with stirring, over a five minute period. Gas evolution occurred and the reaction mixture turned reddish brown in color. After one hour, the reaction mixture was heated to 100° C. (oil bath) for two hours and cooled to ambient temperature. A 1.00 g aliquot of the reaction mixture was removed and 1.00 mL of a solution containing 4.0 g biphenyl in 100 mL toluene was added to serve as an internal standard. An additional 5.00 mL of toluene was added, followed by 50 mL of cold water. The organic phase was washed an additional three times with 50 mL aliquots of water, dried over magnesium sulfate and filtered. Gas chromatographic (GC) analysis of this sample revealed that 98.6% of the chlorobenzene has been destroyed. A repetition of this reaction, in which only 2.33 g (0.02 mole) chlorosulfonic acid was used, resulted in only 75.6% destruction of chlorobenzene after 10 hours of reaction at 100° C. These results indicate that an amount greater than stoichiometric of chlorosulfonic acid is required for efficient chlorosulfonation of chlorobenzene.

EXAMPLE 2

Sulfonation of Chlorobenzene with Sulfuric Acid

A 250 mL three neck flask was equipped as in Example 1. A solution of 2.82 g (0.025 mole) chlorobenzene in 53.58 g mineral oil (5% w:w) was added to the flask and 20.44 g (0.10 mole) of concentrated (96%) sulfuric acid was then added slowly with stirring of the reaction mixture. After about ten minutes, the internal temperature had risen to 45° C. when the exotherm subsided, the reaction mixture was heated to 125° C. for three hours. At the end of this period, the flask was removed from the oil bath and the contents of the flask were cooled to ambient temperature. 50 mL of water was added and this mixture was stirred for five minutes, poured into a separatory funnel, and the phases were separated. The organic phase was analyzed by GC for chlorobenzene, as in Example 1. The destruction of chlorobenzene by this protocol was 98.5%.

EXAMPLE 3

Sulfonation of 3-Dichlorobenzene with Sulfuric Acid

The conditions of Example 2 were employed. A 5% solution (3.68g=0.025 mole of 1,3-dichlorobenzene in 69.83 g mineral water) of dichlorobenzene was reacted with 20.44 g (0.10 mole) of 96% sulfuric acid. After three hours of reaction, 27.4% of the dichlorobenzene was destroyed. In a repetition of this reaction, run under the same conditions, but for 10.50 hours, 77.0% of the dichlorobenzene was destroyed.

EXAMPLE 4

Sulfonation of a Mixture of Chlorobenzene, 1,3-Dichlorobenzene and 1,3,-Trichlorobenzene A solution of2.25 g chlorobenzene, 6.75 g 1,3-dichlorobenzene and 11.26 g of 1,3,5-trichlorobenzene in 80.00 g of mineral oil was added to a 250 mL three neck flask, which was equipped as in Example 1. 60.00 g of concentrated (96%) sulfuric acid was added to this mixture, slowly, with stirring. The reaction mixture was heated to 125° C. for 6 hours with continued stirring and then cooled to ambient temperature. 50 mL of cold water was added and the oil phase was separated and washed with 100 mL water. A 1.00 g aliquot of the oil was removed and 1.00 mL of a standard containing 4.00 g biphenyl/100 mL toluene was added. To this mixture was added 3.00 mL toluene, and the resultant solution was washed three times with 50 mL portions of water, then dried over magnesium sulfate and filtered. GC analysis of the filtrate revealed that 88.4% of the chlorobenzene, 51.3% of the dichlorobenzene and 26.2% of the trichlorobenzene had been destroyed by sulfonation.

EXAMPLE 5

Sulfonation of 1,3-Dichlorobenzene with Oleum

A solution of 3.68 g (0.025 mole) 1,3-dichlorobenzene in 69.83 g of mineral oil was added to a 250 mL flask, equipped as in Example 1. To this solution was added 9.81 g oleum (fuming sulfuric acid containing 20% $SO_3$), slowly, with stirring. The reaction mixture was heated to 110° C. with stirring for three hours, cooled to ambient temperature and analyzed as in the previous Example. GC analysis showed the 86.3% of the dichlorobenzene was destroyed by sulfonation with oleum.

EXAMPLE 6

Detoxification of Aroclor 1242 by Treatment with Oleum, Followed by 3X KGME Treatment A quantity of 5.40 g of the PCB Aroclor 1242 (nominally 100%) was diluted with 21.60 g of mineral oil to give a nominal 20% Aroclor 1242 solution (Analysis of this solution by EPA Method 8080 gave 195,300 ppm Aroclor 1242). This solution was added to a 250 mL three neck flask, equipped as in Example 1, and 10.00 g oleum was added slowly, with stirring. The internal temperature rose to 38° C., and while stirring was continued, the reaction mixture was heated to 90° C. for nine hours. The contents of the flask were cooled to ambient temperature, and the oil phase was separated from the acid phase in a separatory funnel, and returned to the reaction flask. To the oil phase were added 14.61 g of 2-methoxyethanol and 11.97 g of 90% potassium hydroxide, and the reaction mixture was heated to 160° C. for 6 hours, and cooled to ambient temperature. Analysis of the reaction mixture by GC revealed that the Aroclor 1242 concentration had been reduced to 300 ppm.

COMPARATIVE EXAMPLE 7

In a control reaction, the same quantity of a 20% Aroclor 1242 solution was reacted as in Example 6 under the above KGME conditions, but the initial sulfonation step was omitted. When this oil was treated with KGME alone for 6 hours, the Aroclor 1242 concentration was only reduced to 11,100 ppm.

COMPARATIVE EXAMPLE 8

In another reaction, one half the quantity 13.50 g) of 20% Aroclor 1242 was reacted with 6.00 g concentrated sulfuric acid at 110° C. for five hours. The phases were separated, and the oil phase was treated with 2.60 g 2-methoxyethanol and 2.00 g 90% potassium hydroxide and heated to 160° C. for 6 hours. After 6 hours, the Aroclor 1242 concentration was reduced to only 69,000 ppm, demonstrating the desirability for excess KGME.

EXAMPLE 9

Sulfuric Acid v. Oleum

A nominal 20% Aroclor 1242 solution (228,000 ppm by EPA Method 8080) weighing 108.00 g was reacted with 48.00 g of concentrated sulfuric acid at 100° C. for five hours, as in Example 6. Analysis of a 1.00 g aliquot of the oil indicated that the Aroclor 1242 concentration was reduced to 202,000 ppm. A repetition of this reaction, in which the sulfuric acid was replaced with 40.00 g oleum (20% $SO_3$), gave an Aroclor 1242 concentration of 67,200 ppm after five hours of heating at 100° C.

The oil phase from the sulfuric acid reaction was treated with 54.33 g of 2-methoxyethanol and 44.51 g of potassium hydroxide (90%) at 160° C. for five hours. The concentration of Aroclor 1242 was reduced to $<50$ ppm.

Similar treatment of the oil phase from the oleum reaction with 46.88 g of 2-methoxyethanol and 38.41 g of potassium hydroxide (90%) at 160° C. for five hours, also gave 21 50 ppm of Aroclor 1242.

EXAMPLE 10

Reaction of Chlorobenzene/1,3,5-Trichlorobenzene in Mineral Oil with Acetic Anhydride and Ferric Chloride To a 250 mL round-bottom flask equipped with a mechanical stirrer and condenser were added 2.82 g of chlorobenzene, 25.34 g of 1,2,3-trichlorobenzene and 84.45 g of mineral oil. With rapid stirring, 2.55 g of acetic anhydride was added, followed by the addition of 4.06 g of anhydrous ferric chloride, in small aliquots. The entire reaction mixture was heated to 120° C. for five hours, which resulted in the reaction of 23% of the chlorobenzene. The trichlorobenzene did not react.

EXAMPLE 11

Reaction of PCBs with Phosphorous Oxychloride and Triflic Acid

A 250 mL three neck round-bottom flask equipped with mechanical stirrer, condenser and pressure equalizing funnel is charged with 10.00 g of a solution containing 2.00 g Aroclor 1242 in 8.00 g mineral oil. To this is added dropwise through the funnel, with stirring and external cooling (ice), 10.00 g $POCl_3$ and 2.00 g $F_3CSO_3H$. The reaction mixture is heated to 155° C. for five hours, cooled to ambient temperature and poured over approximately 50 g crushed ice to decompose the excess $POCl_3$. The chlorinated biphenylphosphinic acid products are then removed by extraction with 10% NaOH aqueous solution.

EXAMPLE 12

Reaction of PCBs with Methyl Chloride

A 600 mL Parr pressure reactor is charged with 25.00 g of a 20% Aroclor 1242 solution in mineral oil. To this added 0.5 g anhydrous aluminum chloride and the reactor is sealed. A quantity of 5.00 g of methyl chloride gas is added to the sealed reactor, which is then stirred and heated to a temperature of 150° C. for five hours. The reactor is cooled to ambient temperature, vented and the methylated PCB congeners, along with unreacted PCB congeners are extracted with toluene, water washed and dried over magnesium sulfate.

EXAMPLE 13

Aroclor 1221 Destruction by Halogenation of PCB Congeners Followed by KGME Dehalogenation A quantity of 5.00 g 20% Aroclor 1221 in mineral oil (which is very unreactive to nucleophilic reagents such as KGME or KPEG) is added to a 250 mL round-bottom flask equipped with a mechanical stirrer, gas inlet tube and condenser. To this is added slowly, with external ice cooling of the vessel and stirring, 50.0 g sulfuryl chloride, followed by 1.0 g of sulfur monochloride and 1.0 g anhydrous aluminum chloride. The reaction mixture is then heated to 70° C. for five hours, cooled to 0° and 20 mL of concentrated HCl is added slowly. The mixture is then reheated to 70° for 30 minutes, cooled to ambient temperature and extracted with three 25 mL aliquots of toluene, and the extracts are combined and added to a 250 mL round bottom flask. To this is added 1.30 g potassium hydroxide and 1.52 g 2-methoxyethanol, and the reaction mixture is heated to reflux for one hour. After cooling to ambient temperature, the toluene solution is washed three times with 50 mL aliquots of water to remove unreacted KGME. The initial PCB congeners are entirely converted to polyalkoxylated reaction products contained in the toluene solution.

EXAMPLE 14

Nitration of Arochlor 1242 Followed by KGME Dehalogenation

A 250 mL three neck round-bottom flask equipped with mechanical stirrer, condenser and pressure equalizing funnel is charged with 2.0 g fuming nitric acid (density = 1.6). A quantity of 3.0 g concentrated sulfuric acid is added with stirring and external cooling (ice). To this is added dropwise, through the funnel, 15.00 g of a solution containing 3.0 g Arochlor 1242 in 12.0 g mineral oil. The rate of addition is maintained so that the reaction temperature does not exceed 50° C. stirring is continued for 1 h, after which time the reaction mixture is heated to 100° C. for an additional hour. The reaction mixture is then cooled to ambient temperature and poured over approximately 50 g crushed ice. The oily layer containing the nitrated PCBs is removed through a separatory funnel and placed into a clean 250 mL three neck flask to which is added 1.95 g potassium hydroxide, 2.38 g 2-methoxyethanol and 75 mL toluene. This reaction mixture is heated to reflux for 1 h with stirring. After cooling to ambient temperature, the toluene solution is washed three times with 50 mL aliquots of water to remove unreacted KGME. The initial PCB congeners are entirely converted to nitrated polyalkoxylated reaction products which are contained in the toluene solution.

We claim:

1. A method for treating a waste material comprising a halogenated aromatic compound, the method comprising the step of incubating a reaction mixture at a temperature and for a period of time sufficient to form an electrophilically substituted halogenated aromatic compound, the reaction mixture comprising the waste material and an electrophilic aromatic substitution reagent selected from the group consisting of mixtures of $POCl_3$ and trifluoromethanesulfonic acid; mixtures of $HNO_3$ and $H_2SO_4$; mixtures of dimethylformamide and $POCl_3$; $H_2SO_4$; mixtures of $ClSO_3H$; mixtures of $H_2SO_4$ $SO_3$; mixtures of $H_2SO_3$; mixtures of RX and a member selected from the group consisting of $AlCl_3$, $FeCl_3$ and $BF_3$, wherein R is a straight or branched chain alkyl group between $C_1$ and $C_{20}$ and X is a halogen; and mixtures of $R_1COCl$ and a member selected from the group consisting of $AlCl_3$, $FeCl_3$ and $BF_3$, wherein $R_1$ is a straight or branched chain alkyl group between $C_1$ and $C_{20}$ or an aryl group, the reagent being present in an amount sufficient to electrophilically substitute the halogenated compound, wherein a halogen atom of the halogenated aromatic compound is electrophilically substituted by a non-halogen group of the electrophilic aromatic substitution reagent, and wherein the halogenated compound is dehalogenated thereby.

2. The method according to claim 1 wherein the halogenated aromatic compound is selected from the group consisting of PCBs, PCDDs, PCDFs and mono- and dichlorobenzene.

3. The method according to claim 2 wherein the number of halogen atoms contained in the compound is less than or equal to 4.

4. The method according to claim 1 wherein the electrophilic aromatic substitution reagent comprises sulfuric acid.

5. The method according to claim 1 wherein the electrophilic aromatic substitution reagent comprises a mixture of sulfuric acid and chlorosulfonic acid.

6. The method according to claim 1 wherein the electrophilic aromatic substitution reagent comprises a mixture of sulfuric acid and $SO_3$.

7. A method for forming a substituted halogenated aromatic compound, comprising the step of incubating a reaction mixture at a temperature and for a period of time sufficient to form an electrophilically substituted halogenated aromatic compound, the reaction mixture comprising the halogenated aromatic compound and an electrophilic aromatic substitution reagent selected form the group consisting of mixtures of $POCl_3$ and trifluoromethanesulfonic acid; mixtures of dimethylformamide and $POCl_3$; mixtures of RX and a member selected from the group consisting of $AlCl_3$, $FeCl_3$ and $BF_3$, wherein R is a straight or branched chain alkyl group between $C_1$ and $C_{20}$ and X is a halogen; mixtures of $R_1COCl$ and a member selected from the group consisting of $AlCl_3$, $FeCl_3$ and $BF_3$, wherein $R_1$ is a straight or branched chain alkyl group between $C_1$ and $C_{20}$ or an aryl group; and mixtures of $X_2$ and $FeCl_3$, wherein X is any halogen, the reagent being present in an amount sufficient to electrophilically substitute the halogenated compound, wherein a halogen atom of the halogenated aromatic compound is electrophilically substituted by a non-halogen group of the electrophilic aromatic substitution reagent, and wherein the halogenated compound is dehalogenated thereby.

8. The method according to claim 7 wherein the halogenated aromatic compound is selected from the group consisting of PCBs, PCDDs, and PCDFs.

9. The method according to claim 7 wherein the number of halogen atoms contained in the compound is less than or equal to 4.

* * * * *